United States Patent [19]

Hofmann

[11] Patent Number: 4,802,608

[45] Date of Patent: Feb. 7, 1989

[54] SPICE DISPENSER ARRANGEMENT

[75] Inventor: Raimund Hofmann, Kreuzwertheim, Fed. Rep. of Germany

[73] Assignee: Jan Folkmar, Otelfingen, Switzerland

[21] Appl. No.: 92,012

[22] Filed: Sep. 2, 1987

[30] Foreign Application Priority Data

Sep. 3, 1986 [DE] Fed. Rep. of Germany ..... 3629987
Sep. 23, 1986 [DE] Fed. Rep. of Germany ..... 3632188
Jul. 28, 1987 [DE] Fed. Rep. of Germany ..... 3724998

[51] Int. Cl.[4] ..... A47G 19/12

[52] U.S. Cl. ..... 222/142.1; 222/556; 220/256; 220/337

[58] Field of Search ..... 222/142.1, 142.3, 142.4, 222/142.6, 142.7, 480, 498, 517, 544–546, 556, 565; 220/287, 306, 334–335, 337, 256; 215/235, 237

[56] References Cited

U.S. PATENT DOCUMENTS

| | | | |
|---|---|---|---|
| 2,041,024 | 5/1936 | Rueger | 222/498 |
| 2,734,663 | 2/1956 | Lucas | 222/142.1 |
| 3,144,180 | 8/1964 | Phillipps et al. | 222/480 |
| 3,587,944 | 6/1971 | Pehr | 222/480 |
| 3,771,695 | 11/1973 | Pehr | 222/142.4 |
| 3,836,056 | 9/1974 | Pehr | 222/480 |
| 4,095,712 | 6/1978 | Perrella | 220/254 |

*Primary Examiner*—Michael S. Huppert
*Attorney, Agent, or Firm*—Townsend & Townsend

[57] ABSTRACT

In a spice dispenser arrangement comprising a housing having at least one closable spice chamber and an articulately connected closure lid for each spice chamber wherein the spice when the spice chamber is open can be introduced into the latter and when the closure lid is open can be dispensed through at least one sprinkling opening, to obtain economical production and simple handling each spice chamber comprises a closure lid integrally formed thereon. The closure lid permits in a preferred embodiment arresting in various open positions and thus dispensing spices in differently proportioned amounts.

10 Claims, 7 Drawing Sheets

SPICE DISPENSER ARRANGEMENT

The invention relates to a spice dispenser arrangement consisting of a housing having at least one closable spice chamber and an articulately connected closure lid for each spice chamber, a spice being introduceable into the spice chamber when the latter is open and dispensable via at least one sprinkling opening when the closure lid is open.

A spice pot is already known in the form of a salt-cellar in which the housing is screwed together from two parts, the closure lid being detachably articulately connected to the upper housing half. The closure lid is held by means of a tension spring in its closure position and for dispensing the spice can be pivoted through more than 180° into an open position in which it is held by the spring. For replenishing the spice the housing has to be screwed apart.

Also known is a spice dispenser arrangement of the type mentioned at the beginning in the form of a spice pot or jar or the like in which a plurality of spice chambers having a circular segment cross-section are provided. In this known spice jar the spice chamber openings are closed by a separate cap with holding means correspondingly integrally formed on the cap and housing and at the upper side of the cap sprinkling openings for each spice chamber are formed. Furthermore, for closing the sprinkling openings of each spice chamber separate closure lids are secured to the cap.

A disadvantage in the known spice dispenser arrangements is that their production is relatively time-consuming and costly because of the great number of separate parts required. Another unfavourable factor is that for replenishing the spices either the housing has to be screwed apart or the cap secured to the housing must be removed in complicated manner. Also, the manipulation of the hitherto known spice dispenser arrangements is also in need of improvement in so far as a visual check of the spice disposed in the respective spice chamber is possible with the existing designs only from the side.

The invention is based on the problem of providing a spice dispenser arrangement of the type set forth at the beginning which can be economically made and is simple to handle.

Preferred features advantageously further developing the invention are contained in the subsidiary claims.

With the configuration of the spice dispenser arrangement according to the invention the expenditure involved for forming and assembling separate parts is advantageously eliminated. The use of a transparent plastic for the integrally made spice dispenser arrangements offers inter alia the handling advantage that the user can visually determine without restriction from all sides of a spice chamber the type of spice and its presence in the respective chamber.

Preferably, in the housing of the spice dispenser arrangement a plurality of spice chambers are arranged adjacent each other, two adjacent spice chambers having a common wall. The spice chambers preferably have different sizes, the size of the respective associated closure lid being adapted to the size of the opening of the respective spice chamber and in a further preferred manner the spice chambers have a rectangular cross-section which for production reasons widens slightly towards the opening of the spice chamber.

The integral formation of the housing with each closure lid is provided in optimum manner in that each closure lid is articulately connected to the housing via a film hinge and according to a further development of the invention each closure lid in the closed state engages over the opening edge of the associated spice chamber. It is further expedient for simpler handling to integrally form on each closure lid a handling lug which permits an easy pivoting of the closure lid out of its closure position into its open position.

According to a preferred embodiment of the spice dispenser arrangement each closure lid can be engaged in various open positions, preferably by means of at least one detent nose which engages resiliently in housing-side detent depressions associated with various open positions.

In an advantageous further development each closure lid has laterally formed tabs which in predetermined open positions of the closure lid seal the associated spice chamber, at least one sprinkling opening being provided in a connecting wall disposed opposite the articulation of the closure lid and between the tabs. This makes it possible in accordance with the open position of the closure lid in advantageous manner to achieve a variable proportioning in the spice discharge; thus, depending on the angle which the closure lid assumes to the opening plane, with a larger angle a larger spice amount and with smaller angle a smaller spice amount can be dispensed. In addition the adjustability of each sprinkling opening has the advantage that the respective spice chamber can also be used for sprinkling with a spice another powder size or grain size, in particular when the sprinkling openings are provided in the form of elongated slits.

Preferably, in advantageous manner to secure the various positions of the closure lid at least one detent nose is provided adjacent the at least one sprinkling opening.

According to a preferred further development of this embodiment as sprinkling openings two sprinkling slits are provided which extend close to the tabs up to the end of the connecting wall remote from the closure lid, a detent nose being provided between or adjacent the sprinkling slits. This permits through the arrestability of the closure lid in various angles to the opening plane of the respective spice chamber a different proportioning on dispensing the spice concerned. Also, in advantageous manner the detent nose is provided on a tongue-like portion of the connecting wall and can therefore utilize the material elasticity for the engagement into the associated housing-side detent depressions, for example transverse grooves. For filling the respective spice chamber it is also of advantage for each closure lid to be pivotal out of the arrestable open positions.

According to another alternative further development of the housing formed integrally with each closure lid and consisting of a transparent plastic it is advantageous with regard to the production and handling to provide a sprinkling flap formed integrally with the housing for the opening of each spice chamber, each sprinkling flap being pivotal out of a position covering the spice chamber opening into a position freeing the spice chamber opening. Preferably, each sprinkling flap is articulately connected via a film hinge to the housing in such a manner that the sprinkling flap in its position covering the spice chamber opening is disposed beneath the closed lid. Securing of the sprinkling flap in its covering position is preferably implemented by a disengageable detent means.

It is advantageous for the filling of the respective spice chamber to form integrally a handling lug or extension on the corresponding sprinkling flap. This makes it possible to pivot the sprinkling flap easily out of its covering position and thereby permits unrestricted access to the opening of the spice chamber.

Each closure lid is held in its closure position by suitable detent or arresting means. A particularly simple and effective construction of the detent means, simultaneously having the advantage that the sprinkling openings in the sprinkling flap do not clog, consisting in that each closure lid has at least one detent integrally formed portion which in the closure position thereof engages in holding manner into an associated sprinkling opening in the sprinkling flap.

According to one embodiment the sprinkling opening(s) is or are formed in slit manner and extend near the tabs up to the end of the connecting wall remote from the closure lid, a detent nose being provided between the sprinkling or dispensing slits.

According to a further embodiment each closure lid is pivotal out of the arrestable open positions.

A further development is characterized in that a sprinkling flap formed integrally with the housing is provided for the opening of each spice chamber, each sprinkling flap being pivotal out of a position covering the spice chamber opening into a position freeing the spice chamber opening.

According to a further development each sprinkling or dispensing flap is articulately connected via a film hinge to the housing, the sprinkling flap being arranged in its position covering the spice chamber opening beneath the closed lid.

According to a further development of the invention for each sprinkling flap a detent means is provided for the covering position.

Further details, features and advantages will be apparent from the remaining claims and the following description in which examples of embodiment of the invention are explained in detail with the aid of the attached drawings, wherein:

Figure 7:
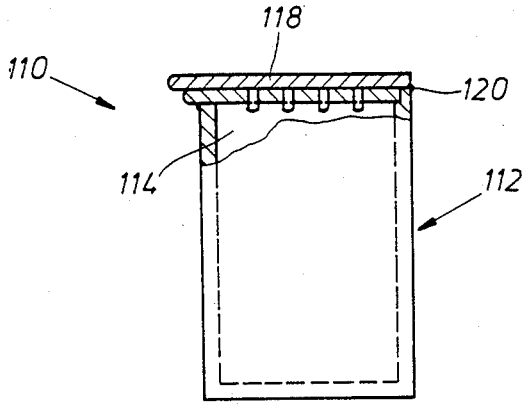
FIG. 7 is a side view of an alternative example of embodiment of a spice dispenser arrangement with closed lid, the view being shown partially in section in the top half.
Figure 8:
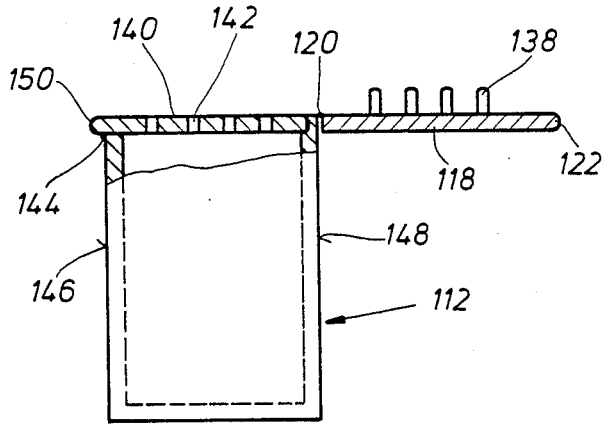
Figure 9:
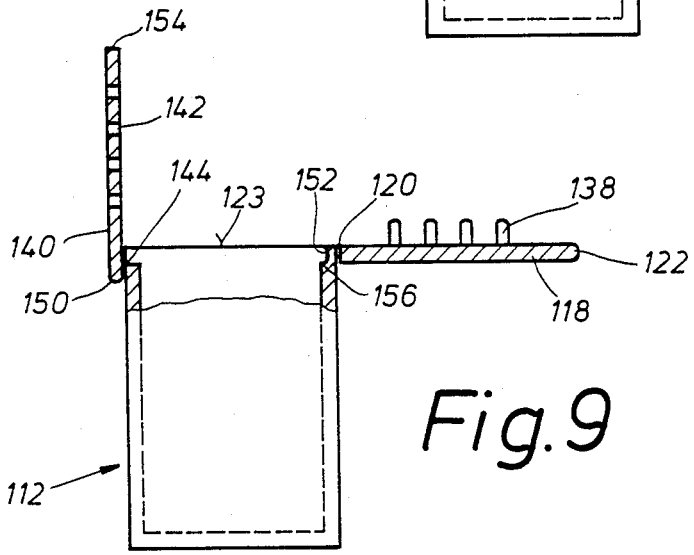
Figure 10:
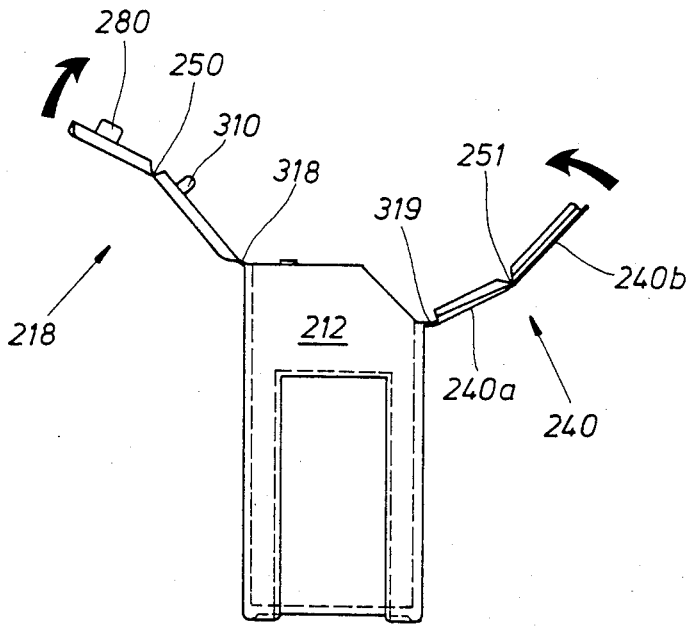
Figure 11:
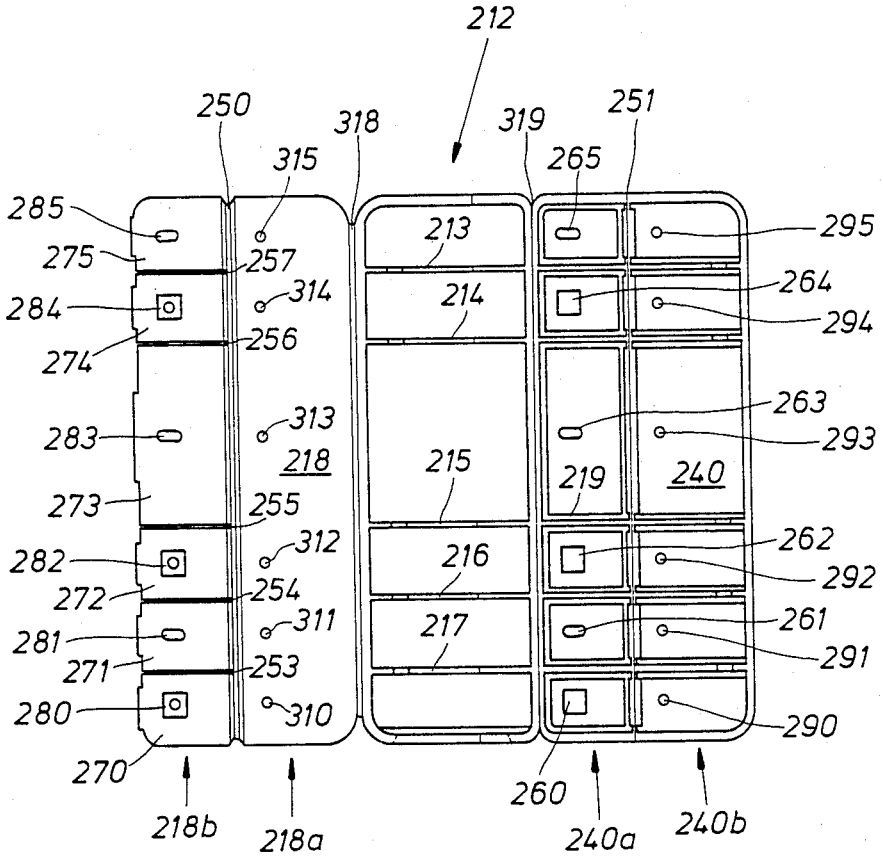
Figure 12:
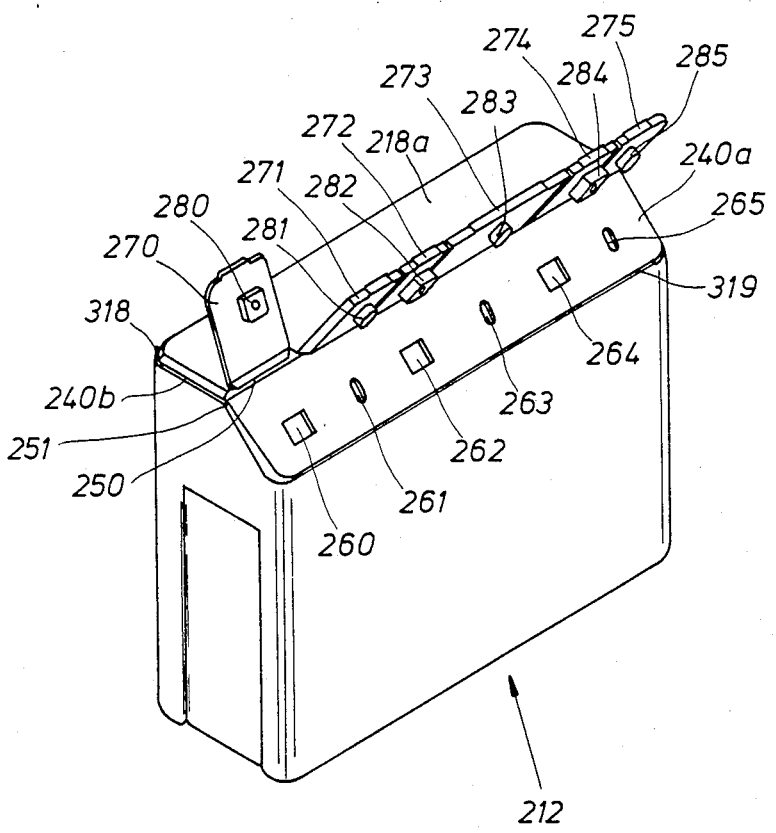
Figure 13:
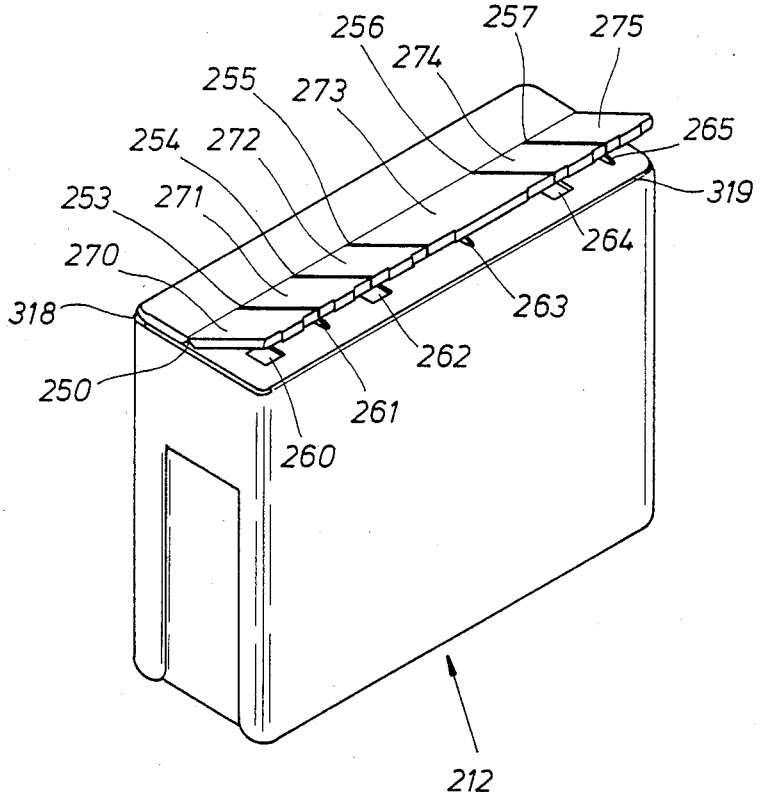

FIG. 8 is a side view according to FIG. 7 but the closure lid is completely opened, FIG. 9 is a side view according to FIG. 8 in which the sprinkling flap is also completely opened, FIG. 10 is a further development of a spice dispenser arrangement or a spice dispenser in perspective side view, FIG. 11 is a plan view of a spice dispenser with opened lids, FIG. 12 is a schematic side view of the spice dispenser with opened closure flaps and FIG. 13 is an embodiment of a spice dispenser modified compared with FIG. 12.

Figure 1:
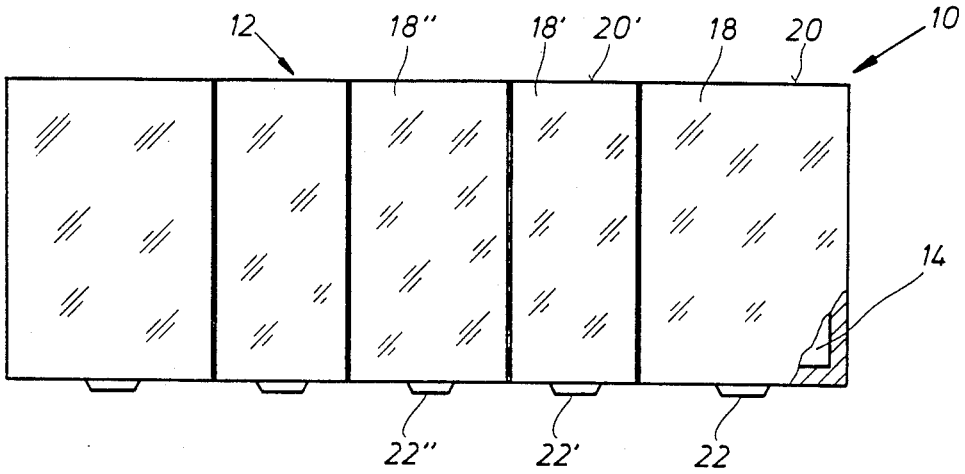
FIG. 1 is a plan view of a first example of embodiment of a spice dispenser arrangement with closed lids.

FIG. 1 shows a plan view of a first example of embodiment of a spice dispenser arrangement 10 according to the invention. The spice dispenser arrangement 10 consists of a housing 12 in which adjacent each other a total of five integrally formed spice chambers 14, 14', etc. is provided, two adjacent spice chambers having a common wall. The spice chambers 14, 14', etc. have a bottom 16 extending over the entire width of the housing 12 and an upper opening 23 and preferably have different sizes. The spice chambers 14, 14', etc. each have preferably a polygonal or rectangular cross-section which for production reasons possibly slightly widens towards the openings of the spice chambers and is either rectangular or square.

Provided for closing the upper opening of each spice chamber 14 is a closure lid 18, 18', 18'', etc., the size of the respective closure lids 18, 18', 18'', etc. being adapted to the size of the opening of the respective spice chambers 14 and each closure lid 18, 18', 18'', etc., engaging in the closed state over the edge of the opening 23 of the associated spice chamber 14 for sealing the latter and being held in its closure position by suitable detent means. Each closure lid 18, 18', 18'', etc. is articulately connected via a film hinge 20, 20', etc. to the housing 12 and has at its side opposite the film hinge 20, 20', etc. a handling or manipulation lug 22, 22', etc. with which the closure lid 18, 18', etc. can be operated. In the embodiment illustrated in FIG. 1 the film hinges 20, 20', etc. are disposed along a straight line at the edge 21, going into the opening 19, of the rear wall designated in FIG. 2 by 23*a* so that the closure lids according to FIG. 1 are each actuable in an arrangement parallel to each other. In an embodiment modified compared with FIG. 1 the closure lids are articulately connected to different upper edges of the spice chambers. This is possible or desirable in particular in an embodiment in which a plurality of individual spice chambers 14 are combinable to a unit, for example can be plugged together with the aid of a dovetail connection or the like, not further described.

The entire housing 12 with the spice chambers 14, 14', etc. formed therein and the closure lids 18, 18', etc. articulately connected via respective film hinges 20, 20', etc. is formed integrally by injection molding from a transparent plastic, for example polypropylene or polyamide.

Figure 2:
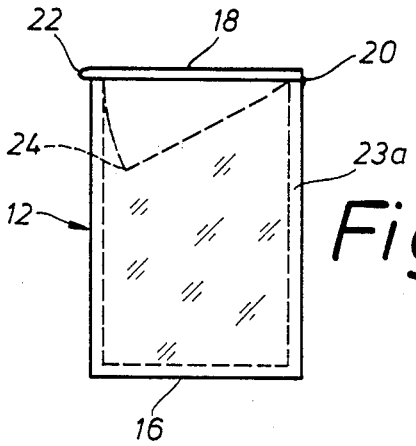
FIG. 2 is a side view of the spice dispenser arrangement illustrated in FIG. 1.
Figure 5:
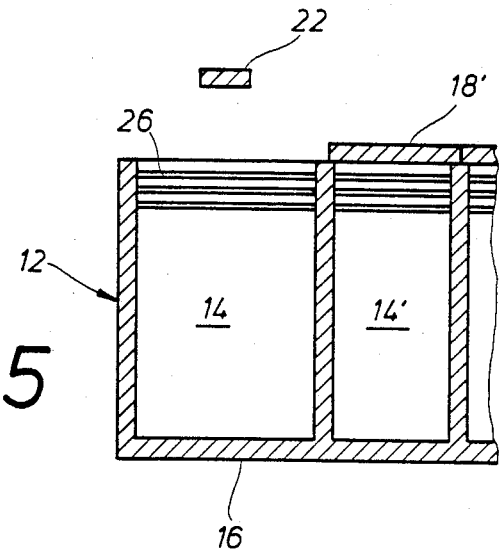
FIG. 5 is a section along the line 5—5 of FIG. 4.
Figure 6:
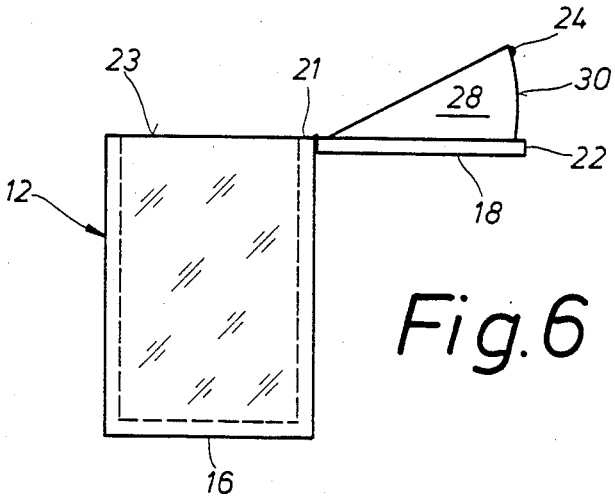
FIG. 6 is a side view according to FIG. 2 but the closure lid is completely opened.

Each closure lid 18, 18', etc. is arrestable in the region of its closure position shown in FIG. 2 in various open positions and pivotal about the film hinge 20 up to the fully opened position illustrated in FIG. 6 in which the associated opening of the spice chamber 14 is completely open for example to fill up with spice. In the various open positions intended for the dispensing each closure lid 18 is engageable at a different angle to the plane of the opening 19 and thereby effects a differently sized total area of the sprinkling openings 32, 34 in a wall portion 30 still to be described. For retaining in the closure position and in the various open positions each closure lid 18 has a detent nose 24 which for securing the various positions of the closure lid 18, 18', etc. resiliently engages in detent depressions 26 (cf. FIG. 5) provided on the housing side. The detent nose 24 is formed as a spot or wart-like integral formation but can also be integrally formed in the manner of a bead to permit a form-locking detent engagement into the detent depressions 26. The resilient engagement of the detent nose is achieved by the material elasticity in the region of the closure lid 18, 18', etc. Other suitable detent means may also be used.

As apparent from FIG. 5 the detent depressions 26 are formed as horizontal transverse grooves which in the region of the opening of each spice chamber 14 are formed in the wall of the spice chamber 14 opposite the film hinge 20. The detent depressions 26 are adapted in their depth, arrangement and inner housing wall as well as their transverse extent to the size of the detent nose 24 and to the different positions provided for the closure lid 18, 18', etc.

Integrally formed on each closure lid 18, 18', etc. at the lower side thereof and laterally are circular segment-shaped tabs 28 and 28'. In the region of the open positions of the closure lid 18, 18', etc. defined by the detents the tabs 28, 28' bear sealingly on the respective associated walls of the spice chambers 14 designated in FIG. 3 by 35*a*, 35*b*, and at the side opposite the film hinge 20 the connecting wall joining the front tab ends together is formed right across the width of the spice chamber 14. The tabs 28, 28' may also be made rectilinear or rectangular and have a common height with the connecting wall 30 and their purpose is to ensure in the various sprinkling open positions of the closure lid that the spice comes out only through the sprinkling openings of the wall 30. The tabs 28, 28', etc. and the connecting wall 30 form beneath each closure lid 18, 18', etc. a scoop-like structure, the connecting wall 30 in the open positions of the closure lid 18, 18', etc. defined by the detent means also engaging sealingly on the wall of the spice chamber 14, 14', etc. in which the detent depressions 26 are formed.

Figure 3:
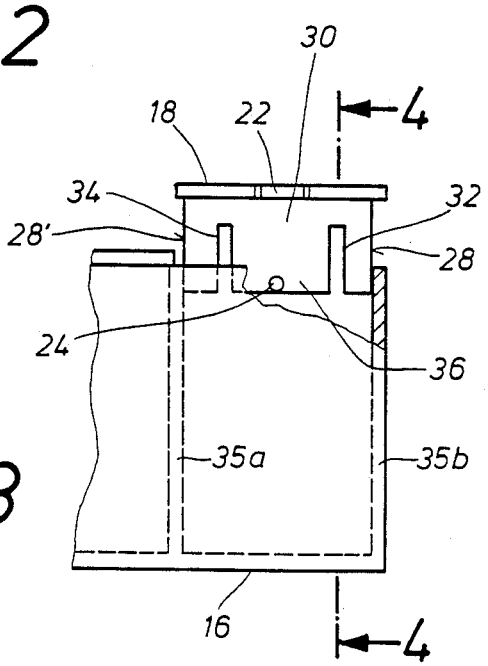
FIG. 3 is a front view of the right part of the spice dispenser arrangement illustrated in FIG. 1, the closure lid of the right spice chamber being disposed in an open position.
Figure 4:
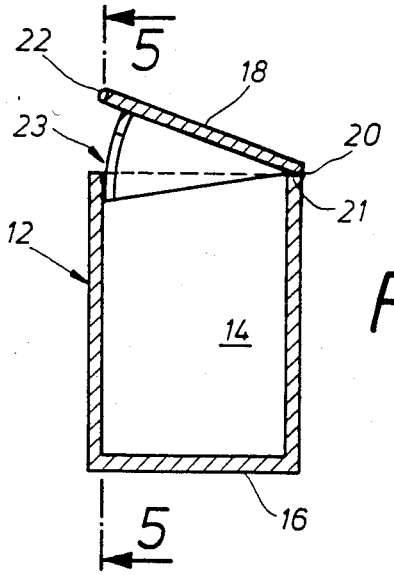
FIG. 4 is a section along the line 4—4 of FIG. 3.

In the embodiment shown in FIG. 3 in the connecting wall 30 two slit-like sprinkling openings 32 and 34 are formed which start just below the handling lug 22 and extend parallel to the tabs 28, 28' up to the lower edge of the connecting wall 30 in the vicinity of the tabs 28, 28' in such a manner that a tongue 36 is formed in the connecting wall 30. The detent nose 24 is disposed centrally at the lower end of the tongue 36 and the latter forms a detent spring for the detent nose 24. The sprinkling openings 32 and 34 may also be replaced by a plurality of substantially circular openings distributed over the connecting wall 30 or openings of other geometrical shapes, for example a downwardly open triangle, for obtaining specific proportioning conditions depending upon the open position of the closure lid 18. Alternatively, the sprinkling openings 32 and 34 may also be provided in the upper region of the wall of the spice chamber 14 associated with the connecting wall 30 and in this case an opening-free connecting wall 30 sets the sprinkling openings in the manner of a slide independently of the open position of the closure lid 18, 18'. For the purpose of filling up with or replenishing spices each closure lid can be brought out of detent engagement into a position pivotal beyond one of the opening positions as shown for example in FIG. 6 and the tabs 28, 28' need not have any contact with the inner walls of the associated spice chamber.

In FIGS. 7 to 9 the example of a modified spice dispenser arrangement 110 is illustrated in which a housing 112 is provided which like the housing 12 of the previously described example of embodiment contains various spice chambers 114. In contrast to the example of embodiment previously illustrated closure lids 118 are provided which are articulately connected via associated film hinges 120 to the housing 112 and have respective handling lugs 122 on which pin-like integrally formed portions 138 are formed which in the closure position of the closure lid 118 are directed towards the spice chamber 114 and project perpendicularly from the lower side of the closure lid 118.

Furthermore, as a difference from the previously described example of embodiment each spice chamber 114 comprises a sprinkling flap 140 with sprinkling openings 142 which is formed integrally with the housing 112 and by means of a film hinge 144 is pivotal out of a position covering the opening 123 of the spice chamber 114 into a position freeing the opening of the spice chamber 114, as illustrated in FIG. 9. The film hinge 144 lies in a plane in the region of the opening 123 of the spice chamber 114 which extends beneath and parallel to the plane in which the film hinge 120 of the closure lid 118 extends. The film hinge 144 is formed on a wall 146 of the spice chamber 114 which extends parallel to a wall 148 with the film hinge 120. The height of the wall 146 is lower by the thickness of the sprinkling flap than that of the opposite wall 48. The film hinges are provided with respect to the spice chamber on two opposite side walls.

The sprinkling openings 142 provided in the sprinkling flap 140 may have cross-sections which are identical to each other or different, their arrangement on the sprinkling or dispensing flap 140 being such that when the closure lid 118 is closed the portions 138 integrally formed thereon engage into the corresponding associated sprinkling openings 142 in retaining manner due to their identical cross-section. Integrally formed on the sprinkling flap 140 is a handling lug 150 with which the sprinkling flap 140 can be pivoted out of its position covering the opening 123 of the spice chamber 114 into a position completely freeing said open 123 for example for the purpose of filling up with or replenishing the spice. For securing the covering position of the sprinkling flap 140 a securing means in the form of a detent means is provided which consists of a depression 152 formed at the upper end of the wall 148 into which in the closed position of the sprinkling flap 140 a corresponding integrally formed portion 154 at the front edge of the sprinkling flap 140 engages. At the lower end of the depression 152 a step-shaped extension 156 is also formed on the wall 148 and serves as stop for the sprinkling flap 140. The depression 152 has for example a substantially concave cross-section into which the correspondingly convexly formed portion 154 can engage in detent manner. The configuration of the handling lug 122 and the handling lug 150 is such that the handling lug 122 when the sprinkling flap 140 is closed and the closure lid 118 is also closed projects beyond the handling lug 150.

The examples of embodiment of the spice dispenser arrangement explained above clearly show the advantages which due in particular to the integral formation with at least two spice chambers permit an extremely simple production and thus low manufacturing costs. Handling advantages result not only from the preferably used transparent material of the entire spice dispenser arrangement but also as regards the uncomplicated replenishing of the spices contained in the individual chambers. As already mentioned the spice dispenser arrangement can be made up or plugged together from a plurality of individual chambers to form a unit whilst retaining the advantages referred to, the individual spice chambers in all embodiments lying adjacent each other practically in a plane and preferably being provided in series adjacent each other.

According to a further embodiment of the invention the spice chambers in contrast to FIG. 1 are not disposed in a row but for example in two rows adjacent each other and/or give an overall square base area. The entire spice dispenser arrangement can consist of single-part or multi-part housings.

Hereinafter a further embodiment of a spice dispenser will be described. According to FIG. 10 the spice dispenser consists of a housing 212 which according to FIG. 11 is divided by substantially vertically extending walls 213 to 217 into various compartments which serve to achieve various spices. At the upper edges of the wide sides of the housing 212 of substantially rectangular cross-section in each case a lid 218 and 240 is pivotally connected as already described in conjunction with FIGS. 7 to 9. Each lid 218, 240 comprises a weakening line 250, 251 which extends in the longitudinal direction and is provided substantially centrally of the associated lid and divides the lid 240 into the portions designated by 240*a* and 240*b* (FIG. 10) in such a manner that said portions 240*a* and 240*b* are pivotal relatively to each other over the weakening line 251. The lid portion 240*a* is directly secured to the corresponding edge of the housing 212. The same applies to the lid 218, the lid portion 218*a* being articulately connected to the container 212 and forming an elongated part whilst the portion 218*b* carries incisions 253 to 257 extending perpendicularly to the weakening line 250. The portion 218*b* is thus divided into flaps pivotally connected to the lid portion 218*a*. For closing the container 212 firstly the lid 240 is pivoted counter-clockwise in FIG. 10, thereby closing the opening formed at the upper side of the container 212, before the opposite lid 218 in accordance with FIG. 12 is partially placed on the lid 240 therebelow. To ensure a tight sealing of the individual compartments or chambers of the container 212 the lower side of the cover 240 in FIG. 11 is provided with a plurality of ribs 219 which can come into sealing engagement with the walls 213 to 217, thereby preventing passage of spice from one chamber to an adjacent chamber when the lid 240 is closed. The ribs or lips 219 preferably have a path corresponding to the associated compartment opening as apparent from FIG. 11. The ribs 219 provide a direct closure together with the walls defining the respective compartment.

The lid 240 comprises in the region of the portion 240*a* openings 260 to 265 which are each closable by one of the flaps denoted by 270 to 275. In order to close the openings 260 to 265 each flap 270 to 275 carries a projection 280 to 285 whose cross-sectional form is substantially identical to the area of the associated opening 260 to 265. As shown in FIG. 12 the flaps 270 to 275 to completely close the spice dispenser are moved in FIG. 12 clockwise about the weakening line 250 to assume a complete and parallel engagement of the lids 270 to 275 on or at the portion 240*a*.

FIG. 12 shows a side view of the container 212 in which the flaps 270 to 275 are represented in the open position so that by tilting the container 212 spice can be shaken out of the openings 260 to 265. In this embodiment the lid portion 240*a* is inclined with respect to the vertical and this facilitates the shaking out of the individual spices from the spice dispenser via the openings thereof whilst the wall portion 240*b* extends practically horizontally. The same applies to the corresponding portions of the lid 218.

According to a further embodiment of the spice dispenser shown in FIGS. 10 to 12 the lid portion 240 is provided with a row of openings or bores 290 to 295 which each serve to receive a stud which is integrally formed on the opposite lid portion 218 projecting from the latter. Said studs are denoted in FIGS. 10 and 11 by 310 to 315. The studs 310 to 315 have a slightly greater cross-section than the associated opening 290 to 295 so that a clamping action is exerted between the studs 310 to 315 and the openings 290 to 250 in such a manner that the two lids 218 and 240 remain in the position shown in FIG. 12 even when one or more of the flaps 270 are opened, i.e. assume the position shown in FIG. 12.

To replenish the container 212 the upper lid 218 is pivoted out of the position shown in FIG. 12 anticlockwise about the upper edge of the housing or container 212 (FIG. 10). To facilitate this pivot movement along the upper edge a weakening line 318 extending along said edge can be provided between the lid 218 and housing 212. A corresponding weakening line 319 is formed according to a further embodiment between the housing 212 and the other lid 240, thereby facilitating the pivot movements of the two lids 218, 240 with respect to the housing 212, the weaking lines 318, 319 defining the pivot axis of the two lids 218, 240.

The embodiment of FIGS. 9 to 11 relates to a spice dispenser whose housing 212 in vertical cross-section has substantially the form of a rectangle which is bevelled at the upper right corner, thus permitting the inclined position of the lid portion 240 in the closed state thereof. In this manner a rapid and simple closing of the opening of the housing 212 and an opening for refilling with spices is ensured. At the same time an easy and simple opening of the individual flaps 270 to 275 with respect to the associated opening 260 to 265 is ensured for dispensing the individual spices or a plurality of spices from their respective chamber.

The embodiment described with reference to FIGS. 10 to 12 can be amended according to FIG. 13 in that the housing 212 in vertical section has a rectangular form so that the lid portion 240*a* extending inclined according to FIGS. 10 to 12 in contrast runs horizontally in FIG. 13. In this embodiment the weakening line 251 of the lid 240 can be omitted but the spice dispenser otherwise has the same structure as described in conjunction with FIGS. 10 to 12. In the embodiment of FIG. 13 for dispensing one or more of the spices the housing 212 must be tilted further than in FIG. 2 to enable the spice or spices to be discharged through the openings 260 to 265.

The embodiments of FIGS. 7 to 13 have essentially in common that the two lids are pivotal towards each other about the upper edge at 318, 319 of the housing wide sides and when the spice dispenser is completely closed substantially come to bear on each other. These two lids can be pivoted in opposite directions for refilling. Whereas in the embodiment of FIGS. 7 to 9 the lids engage in corresponding recesses of the housing, to arrest the lids or lid portions in the embodiment of FIGS. 10 to 13 the openings denoted by 290 to 295 and the securing studs denoted by 310 to 315 are provided. In the embodiment according to FIGS. 10 to 13 compared with the embodiment of FIGS. 7 to 9 a simple raising of the individual flap lids 270 to 275 is made possible because only the flap portions 270 to 275 and not the entire lid 218 need be pivoted to dispense the spices.

Since the studs 310 to 315 are preferably oversized compared with the associated openings 290 to 295 and according to a further advantageous embodiment the projections 280 to 285 are also oversize compared with the sprinkling openings 260 to 265, a firm fit of the lid portion 218*a* on the lid portion 240*a* is ensured as well as a firm fit of the individual closed flaps 270 to 275 with respect to the lid portion having the openings 260 to 265.

For sealing the individual compartments or chambers of the housing 212 with respect to each other the lips or ribs 219 projecting at the side of the closure lid 214 facing the housing interior are provided and in the closed state of said lid 240 project downwardly at least partially into the individual compartments. As FIG. 11 shows the sealing ribs or sealing lips 218 are substantially adapted to the form of the individual compartments. The sealing ribs 218 are formed in the region of the weakening line or film hinge 251 and bevelled towards each other so that on assuming the closure state of the lid 240 shown in FIG. 10 they bridge the weakening line 251. The lid portions 240*a*, 240*b* include an angle which is less than 180° due to the bevelled form of the housing 212 (FIG. 10).

Although the above invention has been described with reference to a spice dispenser arrangement it is clear that the arrangement can also be used to receive other materials than spices. For example the housing could be modified so that in contrast to FIGS. 10 to 13 it has a substantially narrower form and serve for example to receive stacks of tablets or the like.

What is claimed is:

1. A spice dispenser of the type having a housing defining a closable upper opening with oppositely situated first and second edges and having a plurality of closable spice chambers subdivided from each other by walls, the spice dispenser comprising:

a first closure lid, articulately and integrally connected to said first edge of said housing, defining an arrestor stud opening and a sprinkling opening, said first closure lid being displaceable in a closing position over said upper opening;

a second closure lid including a housing-facing surface, a weakening line in said surface dividing said second closure lid into a housing-connected portion and a flap portion, said housing-connected portion articulately and integrally connected to said second edge of said housing and displaceable over said first closure lid when in a closing position, said housing-connected portion including an arresting stud projecting from said surface for engaging and arresting said arrestor stud opening when said first closure lid is in a closing position, said flap portion including an incision extending away from said housing-connected portion thereby dividing said flap portion into at least two flaps, each said flap articulatable about said weakening line and adapted to expose said sprinkling opening in an opening position and adapted to close said sprinkling opening in a closing position.

2. The spice dispenser of claim 1, including a sprinkling opening for each said chamber.

3. The spice dispenser of claim 1, including an arrestor stud and an arrestor stud opening for each said chamber.

4. The spice dispenser of claim 1, including a flap for each said chamber.

5. The spice dispenser of claim 1, wherein said first closure lid includes a housing-facing surface and a weakening line in said surface.

6. The spice dispenser of claim 5, wherein said weakening line in said first closure lid comprises a film hinge.

7. The spice dispenser of claim 1, wherein each said flap includes a protuberance projecting from said surface for engaging and arresting a corresponding sprinkling opening in a closing position.

8. The spice dispenser of claim 1, wherein said housing further includes bevelled sidewalls, and said flap of said second closure lid and a portion of said first closure lid are inclined parallel to each other in a closed position.

9. The spice dispenser of claim 1, wherein said housing-facing surface of said first closure lid further includes ribs for engaging said subdividing walls, thereby arresting said first closure lid over said chambers.

10. A spice dispenser of the type having a housing defining a closable upper opening with oppositely situated first and second edges and having a plurality of closable spice chambers subdivided from each other by walls and including bevelled sidewalls, the spice dispenser comprising:

a first closure lid, articulately and integrally connected to said first edge of said housing, including a housing-facing surface with ribs for engaging said subdividing walls, said surface defining an arrestor stud opening and a sprinkling opening for each chamber, said first closure lid being displaceable in a closing position over said upper opening;

a second closure lid including a housing-facing surface, a weakening line in said surface dividing said second closure lid into a housing-connected portion and a flap portion, said housing-connected portion articulately and integrally connected to said second edge of said housing and displaceable over said first closure lid when in a closing position, said housing-connected portion including an arresting stud projecting from said surface for engaging said arrestor stud opening when said first closure lid is in a closing position to thereby secure the housing-connected portion of the second closure lid to the first closure lid and thereby maintain the first lid and housing-connected portion of the second lid in a position closing the upper opening of the housing, said flap portion including an incision extending away from said housing-connected portion thereby dividing said flap portion into at least two flaps, each said flap including a protuberance projecting from said surface for engaging and arresting a corresponding sprinkling opening in a closing position, and articulatable about said weakening line and adapted to expose said sprinkling opening in an opening position and adapted to close said sprinkling opening in a closing position.

* * * * *